United States Patent [19]

Brugger et al.

[11] 4,030,823

[45] June 21, 1977

[54] COPYING MACHINE

[76] Inventors: Richard D. Brugger, 4818 Walker Blvd., Erie, Pa. 16509; Charles L. Lovercheck, 2319 S. Shore Drive, Erie, Pa. 16504

[22] Filed: Mar. 13, 1975

[21] Appl. No.: 557,973

[52] U.S. Cl. ..... 355/8; 355/3 DD

[51] Int. Cl.[2] ..... G03G 15/30

[58] Field of Search ..... 355/8, 18, 3 R, 11

[56] References Cited

UNITED STATES PATENTS

| | | | |
|---|---|---|---|
| 3,612,679 | 10/1971 | Punnett et al. | 355/8 |
| 3,650,621 | 3/1972 | Lewis et al. | 355/8 |
| 3,652,156 | 3/1972 | Lahr et al. | 355/8 |
| 3,687,539 | 8/1972 | Furuichi | 355/8 |

*Primary Examiner*—L. T. Hix
*Assistant Examiner*—Kenneth C. Hutchison

[57] ABSTRACT

A xerographic copier made up of a machine frame having a suspension mechanism supported in a cabinet so that the frame can be pulled out of the front of the cabinet for servicing. The machine has a drum covered with a removable photo-sensitive sheet of material held in place by double sided adhesive tape and a lens system made up of two lenses. The lenses are swung about an axis passing through the periphery of the drum, and the lenses are maintained at a fixed distance from the document support throughout their movement. A toner dispenser made up of magnetic rubber disposed in the form of a hollow cylinder which moves past a permanent magnet held in fixed position relative to the inner periphery of the cylinder is provided. The magnetic particles in the magnetic rubber are so magnetized that they provide a plurality of spaced magnetic poles, and the permanent magnet cooperates with these poles, causing the particles on the outer side of the hollow cylinder to erect in the form of brush bristles. The permanent magnet can be adjusted so that the brush bristles are formed at the point where the magnetic rubber passes the photoconductor surface. A scanning mechanism is provided for moving the lens frame relative to the document support in synchronism with movement of the photo conductor with the lens frame. This scanning mechanism is made up of a belt running on a pulley the same diameter as the drum, which is synchronized with the drum. A clutch mechanism connects the lens frame to the pulley to move it forward, and a spring is used to move the lens frame backward relative to the document support.

A paper transport mechanism is provided, made up of spaced parallel belts with air jets for holding the paper to these belts and for moving it away from these belts. The paper cut-off, operated by a knife driven by a solenoid, cuts the paper from a roll and directs it down a chute through the paper transfer.

13 Claims, 14 Drawing Figures

COPYING MACHINE

OBJECTS OF THE INVENTION

It is an object of the invention to provide an improved copying machine.

Another object is to provide an improved optical system in a copying machine.

Another object is to provide an improved magnetic brush.

Another object is to provide an improved optical scanning system and scanning mechanism combination.

Another object is to provide an improved drum and photo sensitive carrier.

Another object is to provide an improved toner brush in a copying machine.

Another object is to provide an improved paper cutoff in a copying machine.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF DRAWING

Figure 1:
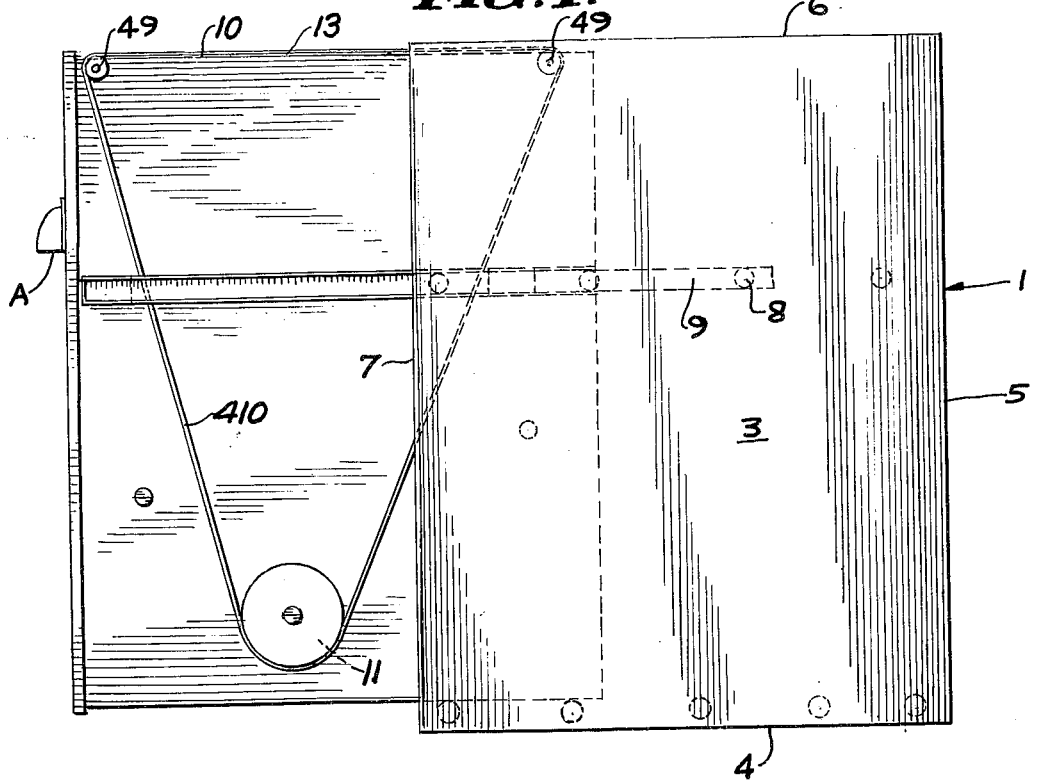
FIG. 1 is a side view showing the mechanism carrying frame moved partly out of the cabinet as for servicing.
Figure 2:
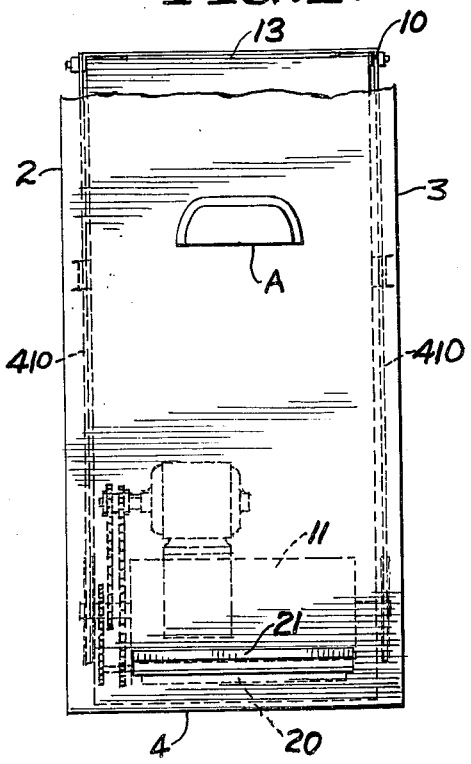
FIG. 2 is a front view of the xerographic copying machine according to the invention.
Figure 3:
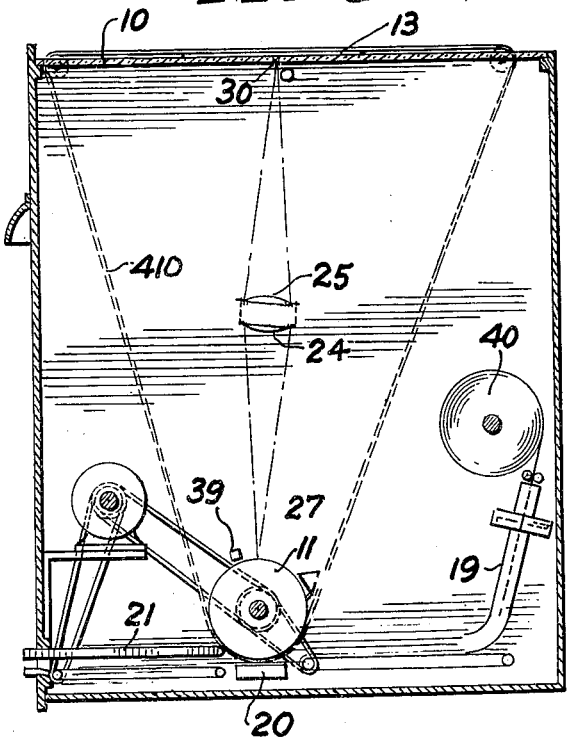
FIG. 3 is a longitudinal cross sectional view of the chassis removed from the machine.
Figure 5:
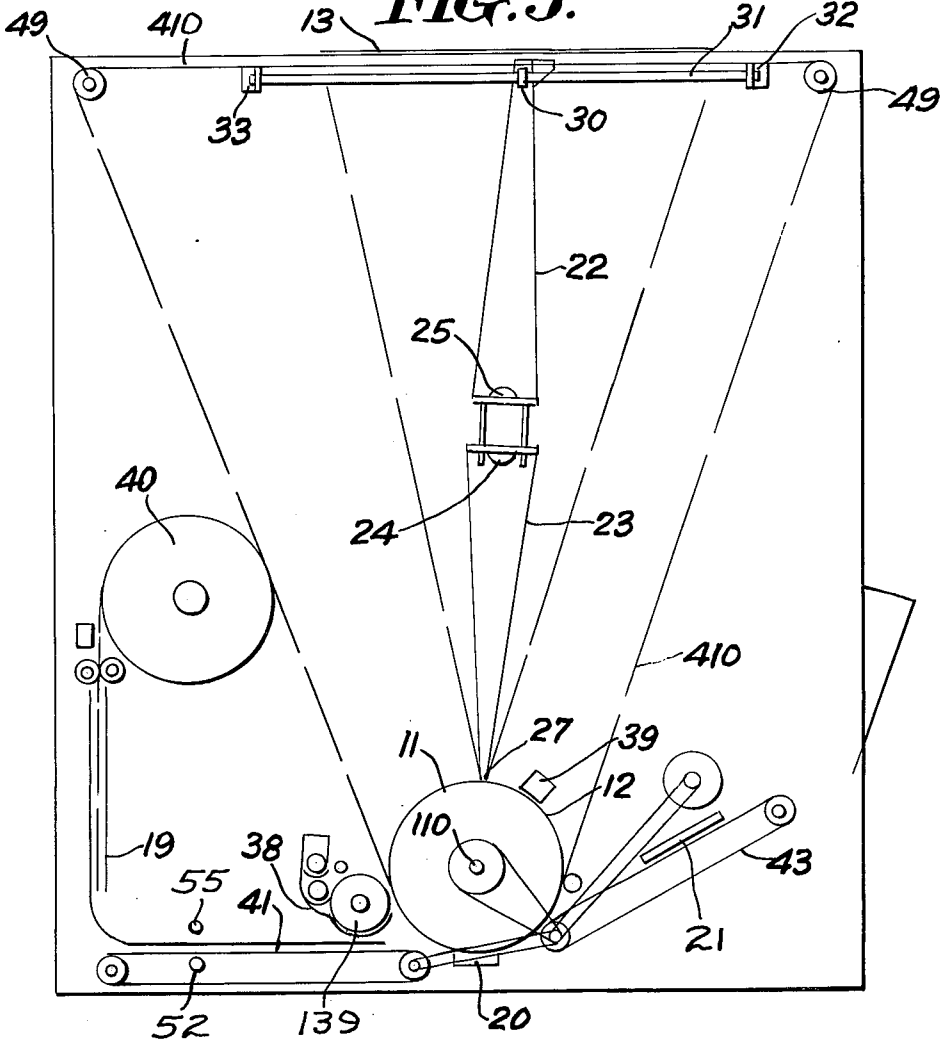
FIG. 5 is a side view of the lens system shown in FIG. 4, plus other system components (elements).

Now with more particular reference to the drawings a machine has a frame 10 housed in cabinet 1 (FIGS. 1-3). Cabinet 1 has the size and configuration of a three-drawer legal size office filing cabinet of a type familiar to those skilled in the art. The cabinet 1 has sides 2 and 3, bottom 4, rear end 5, top 6, and open front 7. The frame 10 is supported on rollers 8 which are rotatably supported between sides 2 and 3. The rollers 8 are received in the channel shaped tracks 9 which are fixed to the sides of the frame, and the frame

10 can be pulled in and out of the cabinet for a convenience of sevicing the machine. The front of the cabinet frame 10 has suitable handle A fixed to it by which the mechanism can be pulled in and out, and the control mechanisms and dials can be supported on the front of the mechanism frame 10. A document support 13 is supported on the top 6 of the cabinet.

A document to be copied, such as a book or a letter, can be laid on the document support 13 for copying.

Figure 12:
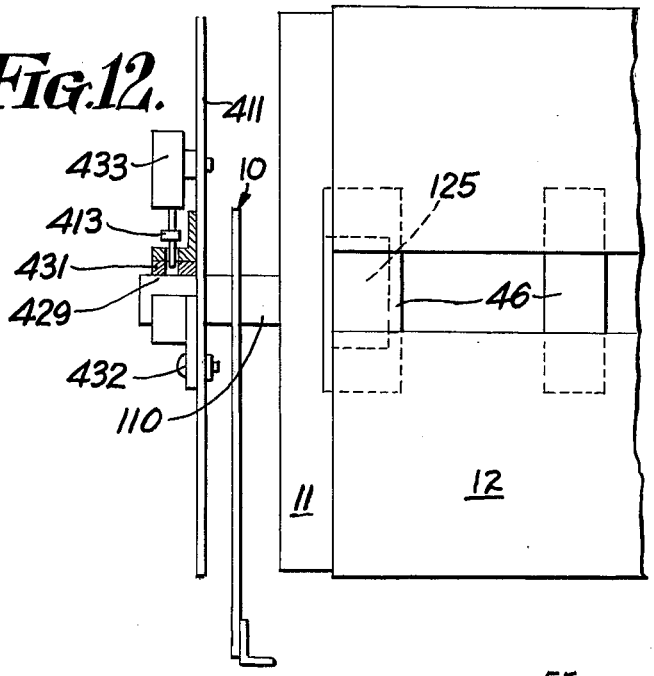
FIG. 12 is an enlarged partial view of the drum cover and scanning clutch.

The frame 10 supports a drum 11 on shaft 110 which will be carried on suitable bearings on the frame 10. The drum 11 may be made of a hollow tubular section having closed ends attached to the shaft 110, and a photo-sensitive cover 12 is wrapped around the drum and held in place by the double sided adhesive strips 46 (FIG. 12) which adhere to the outer periphery of the drum and to the inner ends of the photo-sensitive sheet material 12. The photo-sensitive sheet material 12 may be any of the photo-sensitive sheets that are familiar to those skilled in the art of xerographic copying machines.

Figure 4:
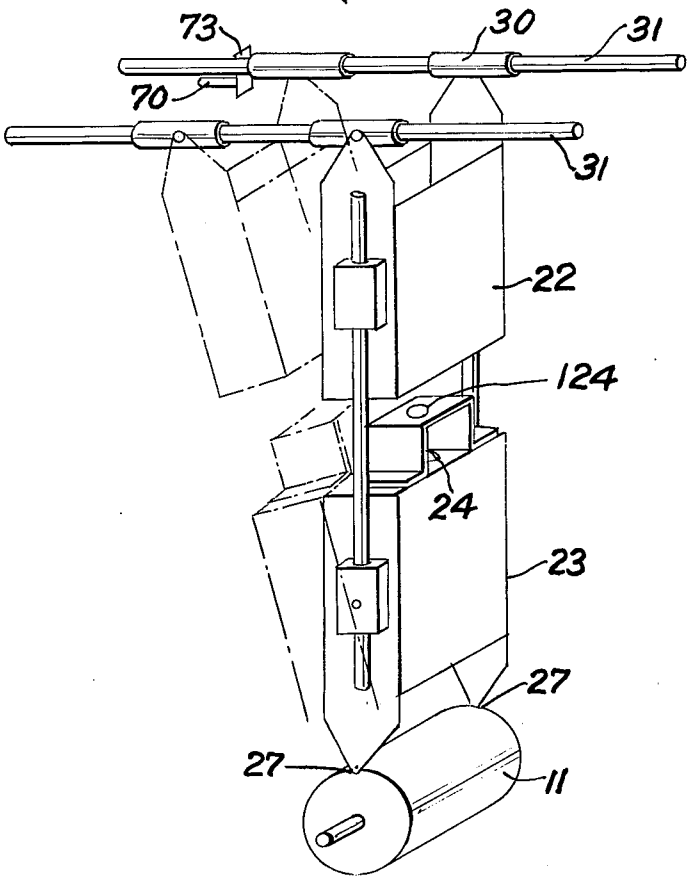
FIG. 4 is an isometric view of the scanning mechanism.
Figure 6:
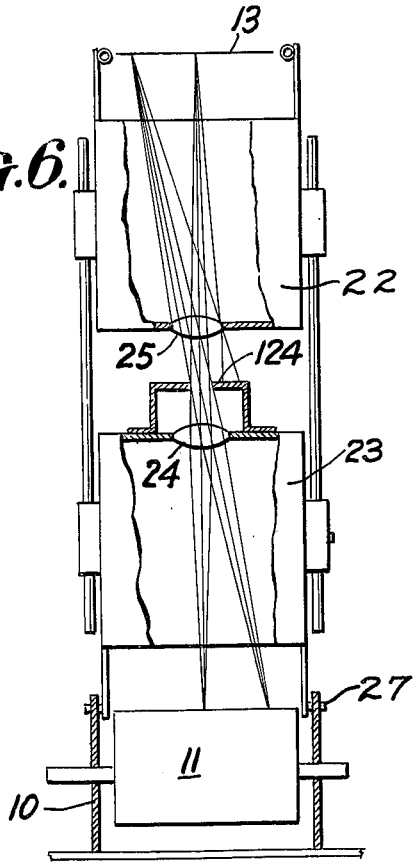
FIG. 6 is schematic view of the scanning mechanism showing the light path through the lens system with copying the top or bottom of a page.
Figure 7:
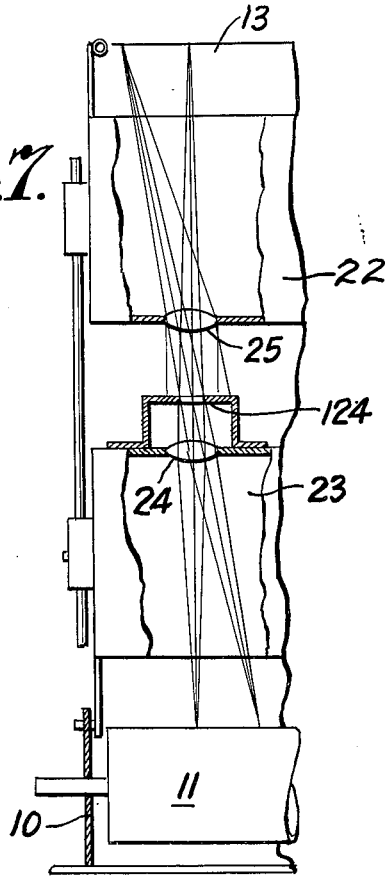
FIG. 7 is a view similar to FIG. 6 showing when copying the center of a page.

The function of the aperture stop 124 (FIGS. 4, 6, and 7) is to slightly increase the focal depth of the field, which in turn relaxes the requirement on the mechanical tolerance, a major cost consideration. The advantages of the system over conventional systems are, (a) simple and low cost, (b) no scanning mirror or rotating mirror required, (c) no fixed mirror required, (d) only two optical parts to align and maintain in alignment, (e) relaxed mechanical tolerance requirements, (f) self-compensating for the varying distance from the copy on support 13 to the photoconductor supported on drum 11.

The lens system (FIGS. 4-7) includes lenses 24 and 25. The first lens 24 is supported on the first lens frame 23, and the second lens 25 is supported on the second lens frame 22. The lower end of the lens support 23 is pivoted at 27 to the mechanism frame 10 on a line passing through the photoconductor 12 on drum 11. The second lens support 22 is slidably supported on bearings 30 that are carried on tracks 31, and tracks 31 are fixed to the sides of the mechanism frame 10. The ends of the tracks 31 are received in holes in blocks 32 and 33, which are fixed to the frame 10.

The early method for providing a photo-sensitive surface in xerographic type machines was to deposit or plate the photo-sensitive surface directly on the drum. Later the photo conductor surface was put on a sheet which was rolled in the form of a scroll, and the intermediate part of the scroll was wrapped around the drum. Photoconductive surface coverings for the drum in xerographic copying machines have become quite common. The covering is now normally provided on a roll somewhat like a photographic film roll. The source roll and the take up roll are both located inside the drum on this type of machine. A length of photoconductor surface is unrolled and drawn around the drum, the long path between the source and the pickup roll. This length of photoconductive surface is retained in that position for a pre-determined number of copies. Then an automatic system causes the length of photoconductor to move into the position outside of the drum. The mechanisms to record the number of copies made on the exposed surface and then cause the rewinding operation to take place are quite expensive. Furthermore, the storage of a large quantity of photoconductive surface in the machine represents a considerable expense that the machine owner invested for an extended period of time. The new method disclosed herein proposes a simple solution that is economical and overcomes all the objections involving cost and complexity of structure of the present practice. The drum shown in the drawing (FIG. 12) has a strip of double sided masking tape 46 to secure one end to the photo-conductive surface. The drum is rotated and the photo conductor is wrapped around the drum until the second end of the photo conductor can be secured to the double sided tape.

The surface, when in place, is restrained by the tape for making copies except that the photoconductor surface must be electrically connected to the drum, which is in turn tied in electrically to the equipment frame ground. Two grounding straps 125 are shown electrically connecting the photo conducting surface to the drum. When the grounding straps 125 are in place, a grounding path is provided from the photo conductive surface to the drum.

A resurfacing kit could include a single length of drum cover, a piece of double sided tape having pressure sensitive adhesive on it and one or two grounding straps. An alternte method of surface attachment involves a permanent adhesive region at each end of the length of drum covering and a removable tear strip to expose the adhesive coated surface.

The following advantages relate to the above system:

a. simplicity and inexpensive method of attachment,
b. need not remove drum from machine to resurface,
c. the gears normally used to advance the surface are eliminated,
d. it is not necessary to store a large amount of expensive resurfacing material in the machine.

Figure 8:
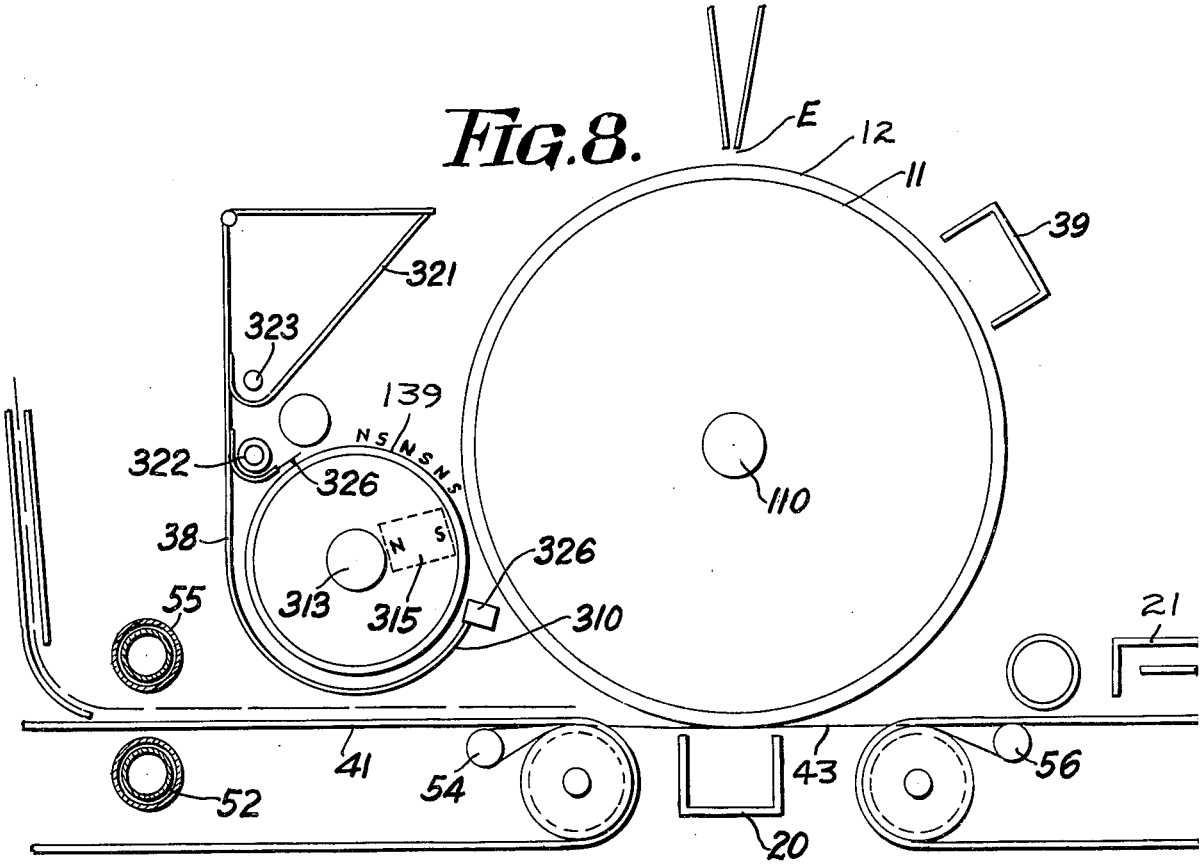
FIG. 8 is a side schematic view of the drum and paper transport mechanism.
Figure 11:
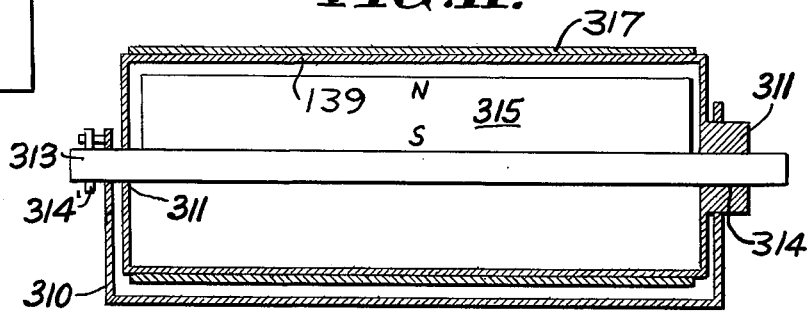
FIG. 11 is a cross sectional view of the toner brush.
Figure 13:
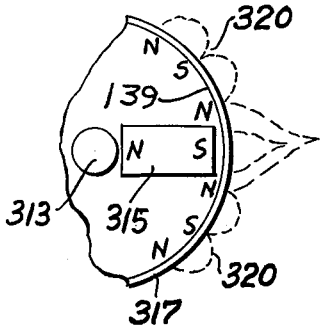
FIG. 13 is a partial end view of the magnetic toner brush.

The magnetic brush while applies the powder material to the charge photoconductive surface 12 is shown in FIGS. 8, 11, and 13. The magnetic brush 139 is rotatably supported in the hopper 310 by means of the bearings 311, which form the closure for the ends of hollow non-magnetic cylinder 139. The hollow non-magnetic cylinder has closed ends with the bearings which are hollow bosses 311, extending outwardly from the ends thereof. A shaft 313 is received in the hollow 314 of the members 311. A crank arm 314' is fixed to the shaft 313 and prevents the shaft 313 from rotating. A permanent magnet 315 is fixed to the shaft 313 and extends outwardly therefrom. The magnet 315 rests on this shaft 313, which is made of magnetic material, and projects a field outwardly through the magnetic rubber 317. The magnetic rubber is polarized as shown in FIG. 13 so that fields 320 project outwardly from the magnetic rubber around the outer periphery thereof. Thus, as the bosses 311 rotate, driven by a suitable driving mechanism, the magnetic rubber covering on the brush 139 rotates in the hopper and picks up the magnetic particles having the toner material fixed thereto, and this material is attracted to the drum by a tribo-electric effect familiar to those skilled in the art. Additional toner may be introduced into the hopper 321, which will be sifted down into the hopper 322 by an agitating member 323. This will, in turn, be dropped onto the space around the magnetic brush and baffle 38. The surplus magnetic particles will be doctored by the blade 326 so that they will fall down into the hopper 310, or magnetic rubber 317 will pick up additional magnetic particles from hopper 310 to the toner material thereon.

It is important that the lenses on frames 22 and 23 move in synchronism with rotation of the drum so that an inch of travel along the document support 13 will take place in exactly the same time that an inch of movement of the periphery of drum 11 takes place. This is accomplished by belt 410 (FIG. 5), which passes around pulleys 49 at the top of the machine and passes around the pulley 411 which rotates on to the drum shaft 110. The clutch mechanism (FIG. 12), which includes solenoid 433, is fixed to the pulley 411, and when a copy of a document on support 13 is to be made pin 413 is moved down into hole 429 in bushing 431. Bushing 431 is keyed to shaft 110. Set screw 432 locks bushing 431 to the shaft and moves the scanning frame 22, 23 to the end of its travel in one direction. A stop engages a suitable switch 70 causing it again to actuate solenoid 433. Thus, when pin 413 is in slot 429 pulley 411 rotates with shaft 110. When frame 22–23 comes to the end of its scan a limit switch 70, 73 (FIG. 4) causes solenoid 433 to retract pin 413.

Figure 9:
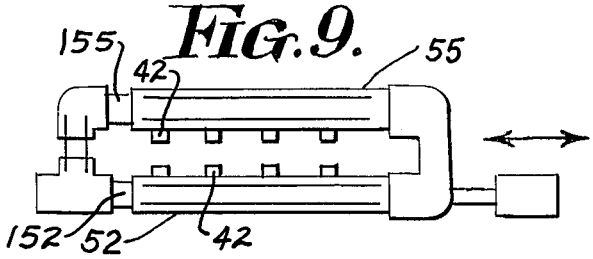
FIG. 9 is a partial top view of the paper clutch part.
Figure 14:
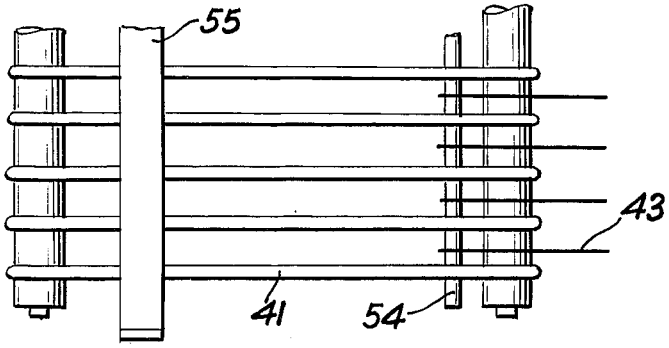
FIG. 14 is a top view of the paper transport.

The cut paper from supply roll 40 (FIG. 5) falls down chute 19 onto belts 41; air from jets 42 in air pipe 55 (FIG. 9) holds the paper to the belts and this carries it to drum 11. Drum 11 pulls the paper over nylon threads 43 (FIGS. 5, 8 and 14) which are held by bars 54 and 56 and over corona charger 20, which transfers toner powder from the drum to the paper. Corona charger 39 charges the photoconductor. Light projecting onto the photoconductor 12 at exposure slot E fixes the electrostatic image of the document onto the photoconductor. Toner is applied by brush 139 and transferred to the sheet of paper by corona charger 20. The sheet proceeds by second conveyor 43 to fuser 21, where the toner is melted to the paper.

AIR CLUTCH

When a copy of a document is to be made, a length of paper is cut from the paper supply roll 40 and the cut piece of paper falls down the chute 19 onto belt 41. Air from jets 42 in the air pipe 55 holds the paper to the belt, and the paper is carried by the belt to the drum 11.

Figure 10:
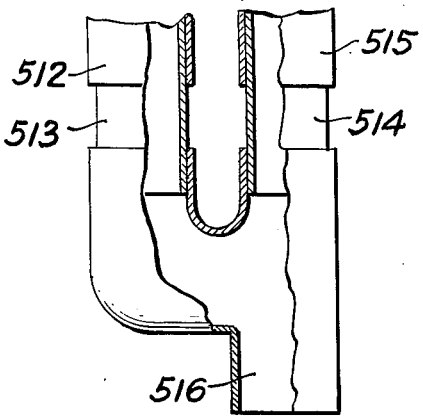
FIG. 10 is a partial cross sectional view showing the paper clutch air supply.

The air is then directed to the lower pipe 52, lifting the paper from the belt until the drum rotates to the starting position for making the copy, where it is then directed from the upper pipe 55 onto the paper, again, holding it to the belt which moves the paper between the drum 11 and the coronation 20 where the toner is transferred from the photo-conductor 12 to the paper. Coincidence of holes in 514 and 515 (FIG. 10) allows air from the four jets to be directed at one side of the paper. Similarly, coincidence of holes in 512 and 513 allows jets of air to be directed on the other side of the paper. Lateral motion of one member is shown by arrows in FIG. 9. Either the jet from members 514, 515 or from members 512, 513, but not from both at the same time, may be selected. Thus, a slight lateral shift of the tubes causes the jets to be directed down from 55 to press the paper onto the moving conveyor 41 or to be directed up from 52 to lift the paper from the conveyor 41. The paper then moves on below the fusing mechanism 21 where the toner is melted and is thereby caused to adhere to the paper.

The foregoing specification sets forth the invention in its preferred practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. A machine for copying documents comprising,
a document support,
a frame,
a cylindrical drum,
means supporting said drum on said frame to rotate about its longitudinal axis,
a photo conductor sheet supported on the outer periphery of said drum,
means holding said photo conductor sheet to the outer periphery of said drum,
a lens frame supported on said machine,
said lens frame supporting a first lens and a second lens,
means to move said lens frame through an arcuate path having its center of curvature on the outer periphery of said drum and at a speed proportional to the peripheral speed of said drum,
a means to support a supply of paper for receiving an image from said photo conductor sheet, and
conveyor means for carrying said paper from said supply into close relation with said drum and then to a dispensing means.

2. The machine recited in claim 1 wherein said machine further comprises means supported on said frame to move said first and second lenses and said photo conductor means relative to said document support whereby said lenses scan said document support to project an image on said photo conductor means in synchronism with a movement of said lenses relative to said document support,
said document support and said drum being disposed in the focal plane of said first lens and said second lens respectively so that the rays traveling from said first lens to said second lens are parallel to the common axis of the two lenses,
and means to maintain a fixed distance between said first side of said first lens and said photo conductor means,
and means to maintain a fixed distance between said first side of said second lens and said document support,
said second side of said first lens and second side of said second lens being directed toward each other.

3. The copying machine recited in claim 1 wherein means is provided to direct an image on said photo conductor means
said conveyor comprising a belt,
paper delivery means for delivering paper to said belt, means to hold said paper to said belt comprising air jets directed towards said belt whereby said paper is held to said belt and moves past said photo conductor means.

4. The machine recited in claim 3 wherein said conveyor comprises two conveyor belts disposed in tandem with each other,
a high voltage means disposed between said machine frame and said photo conductor,
wire means for directing paper from said first conveyor to said second conveyor and wherein said air jets direct air toward said first conveyor and also direct air toward said second conveyor whereby a sheet of paper may be held to said first conveyor and to said second conveyor.

5. The copying machine recited in claim 1 wherein said machine has a toner brush supported adjacent said drum and said toner brush comprises a sheet of magnetic rubber having spaced magnetic poles therein,
a pemanent magnet support adjacent said magnetic brush and adjacent said photo conductor means,
means for moving said magnetic brush relative to said photo conductor means between said permanent magnet and said photo conductor means,
means to apply toner particles and magnetic means associated therewith to said magnetic rubber sheet whereby said toner particles are urged from said magnetic rubber sheet toward said photo conductor means,
means to move said magnetic rubber sheet relative said conductor means.

6. The copying machine recited in claim 1 wherein said means supporting said photo conductor on said drum comprises a strip of sheet material having pressure sensitive adhesive on both sides thereof,
said photo conductor means being wrapped around said drum and having a first end and a second end spaced from each other,
said adhesive on one side of said strip means engaging the underside of said photo conductor means,
the adhesive on the second side of said strip means engaging said drum whereby said photo conductor means is held in place on said drum,
and means electrically connecting the outside of said photo conductor means to said drum.

7. The machine recited in claim 6 wherein means for dispensing particulate material is supported on said machine adjacent said drum and a cylindrical magnetic brush,
means for rotating said magnetic brush with the periphery of said magnetic brush in close proximity to the said photo conductor sheet,
and means to supply said particulate material to said brush at a position remote from said brush,
said brush having an outer cylindrical surface made of a non-magnetic material containing material magnetized to form spaced magnetic poles around the outer periphery of said brush,
and a permanent magnet supported inside said magnetic brush and held against rotation relative to said brush and adjacent said photo conductor sheet on said cylindrical drum,
said permanent magnet being adapted to cause said particulate material to erect into the form of brush bristles on the surface of said magnetic brush and said particulate material pass said photosensitive material whereby said particulate material is deposited on said photo conductor sheet.

8. The machine recited in claim 7 wherein said means for feeding said particulate material comprises a hopper having openings in the bottom thereof,
an agitator member in said hopper for urging said material through said openings.

9. The machine recited in claim 8 wherein said agitator comprises a shaft rotatably supported on the bottom of said hopper and disposed generally parallel to the bottom thereof,
said shaft having a wire loop member supported thereon.

10. The machine recited in claim 9 wherein said agitator comprises a platelike member fixed to said shaft and spaced from the inner surface of said hopper.

11. The machine recited in claim 10 wherein a mixing member is provided adjacent said magnetic brush, and means is provided for removing said particulate material from the outer periphery of said brush on the portion thereof passing said photosensitive sheet, and means to mix said material removed from said magnetic brush with particulate material passing from said hopper.

12. The machine recited in claim 11 wherein the cabinet comprises a top section and a bottom section, said bottom section is approximately twice the height of the top section, means to lock said top section to said bottom section, said bottom section contains said console, and said top section has a transparent plate thereon for supporting a document to be copied.

13. The machine recited in claim 10 wherein a cabinet is provided and said frame is supported in said cabinet and said frame is slidable into and out of said cabinet on anti-friction means.

* * * * *